US005106068A

United States Patent [19]

Honegger

[11] Patent Number: 5,106,068

[45] Date of Patent: Apr. 21, 1992

[54] METHOD AND APPARATUS FOR THE POST-PRINTING CLUSTER PROCESSING OF PRINTED PRODUCTS

[75] Inventor: Werner Honegger, Tann Rüti, Switzerland

[73] Assignee: Ferag AG, Hinwil, Switzerland

[21] Appl. No.: 700,874

[22] Filed: May 10, 1991

Related U.S. Application Data

[63] Continuation of Ser. No. 394,880, Aug. 17, 1989, abandoned.

[30] Foreign Application Priority Data

Sep. 9, 1988 [CH] Switzerland ..... 3380/88

[51] Int. Cl.[5] ..... B42C 1/00

[52] U.S. Cl. ..... 270/54; 270/52; 270/58; 270/32; 270/53

[58] Field of Search ..... 270/1.1, 54–58, 270/53, 37, 52, 52.5, 45, 32

[56] References Cited

U.S. PATENT DOCUMENTS

| | | | |
|---|---|---|---|
| 3,951,399 | 4/1976 | Reist | 270/58 |
| 3,982,453 | 9/1976 | D'Amato | 270/58 |
| 4,234,178 | 11/1980 | Beckert | 270/58 |
| 4,279,410 | 7/1981 | Bolza-Schunemann | 270/50 |
| 4,463,677 | 8/1984 | Kuehfuss | 270/1.1 |
| 4,466,603 | 8/1984 | Schnell | 270/58 |
| 4,572,497 | 2/1986 | Dreschel | 270/58 |
| 4,601,462 | 7/1986 | Bowman | 270/53 |
| 4,706,951 | 11/1987 | Leu | 270/55 |

FOREIGN PATENT DOCUMENTS

| | | | |
|---|---|---|---|
| 3323842 | 1/1985 | Fed. Rep. of Germany | 270/58 |
| 2072631 | 10/1981 | United Kingdom | 270/54 |

*Primary Examiner*—John T. Kwon
*Assistant Examiner*—Therese M. Newholm
*Attorney, Agent, or Firm*—Walter C. Farley

[57] ABSTRACT

The further processing and conveying of printed products with a high capacity takes place in such a way that the printed products are organized into clusters (2, 2'). A printed product cluster is a group of at least two individual printed products, which are jointly processed in cluster flows at least over a partial segment or process. Such a cluster flow can be split up or reduced to a lower order cluster flow (decreasing number of printing products per cluster). It is also possible to mix or combine cluster flows. This makes it possible within an overall system to create an upwardly open processing capacity at the desired points or stations. The method simultaneously permits increased flexibility by specific buffering possibilities, redundancy, etc., with a relatively low material and cost expenditure.

14 Claims, 5 Drawing Sheets

METHOD AND APPARATUS FOR THE POST-PRINTING CLUSTER PROCESSING OF PRINTED PRODUCTS

This application is a continuation of U.S. Ser. No. 07/394,880, filed Aug. 17, 1989, now abandoned.

The invention is in the field of printing technology and relates to a method and apparatus for forming printed products into clusters and processing the clusters.

BACKGROUND OF THE INVENTION

In modern printworks ever higher processing speeds and capacities are required in connection with the further processing of printed products from rotary presses. This is inter alia due to the fact that modern rotary presses permit, apart from multi-colour printing, high quality offset printing and consequently there is an increase in the number of brochures, magazines and other printworks products which can be produced. Simultaneously processing must have great flexibility, so that the maximum number of final formats of the printed products must be obtainable using the same plant. Significance is also attached to costs, because in flexible plants identical components must be usable for different functions, whilst permitting the very satisfactory use of high capacity partial plants. However, flexibility is also required in connection with the extendability of plants, because often at a later time an existing plant must be usable for larger numbers or for new printed products. There is also a desire for maximum utilization and loading of systems, particularly in view of the relatively high costs for printing presses and conveying systems.

Conventional conveying and processing plants in printworks are all based on serial processing concepts. Printed products or partial products are usually conveyed by means of conveyor belts, conveyors, etc. in a conveying line, often as a scale or stream flow and supplied to processing plants. Since, as a result of their operating principle, rotary presses generally print paper webs in serial form, it is natural to further process the printed products in serial manner. Serial processing is often also necessary due to the working steps during further processing requiring a serial sequence. Therefore up to now conventional conveying and processing plants have had to adhere to this serial principle.

For special applications, particularly when high processing capacities are desired, serial processing plants are adapted and precautions taken leading to a certain processing capacity increase. However, these precautions have only related to specific bottlenecks in processing and no solution has been provided to the fundamental problem, i.e. increasing the processing capacity and in particular making the overall plant or at least certain working steps therein more flexible. Thus, e.g. buffer plants or means have been provided, or by using sorting gates the printed product flow has been subdivided into several partial flows. Such an apparatus is e.g. described in U.S. Pat. No. 4,866,910, Reist. This invention discloses a method and an apparatus in which one or more continuous flows of printwork products is subdivided onto the feed segments of at least two processing stations without using buffer means. Another method according to U.S. Pat. No. 4,402,496, Müller shows how a conveyor is subdivided into several paths, "so as to be able to make it possible to use the known and proven conveying technology". The problem to be solved is to maintain the feeder capacity, whilst retaining the aforementioned conveying technology.

However, it has been found that the "known and proven" serial conveying concepts suffer from significant disadvantages, which are particularly prominent in the case of large conveying capacities. As in all serial processes, bottlenecks necessarily occur at points having a longer passage time or a slower clock cycle, which is also due to inadequate flexibility. As stated hereinbefore, the problems of such a bottleneck can be partly solved with a buffer. However, if the flow must pass through a bottleneck for a long period or even permanently without any interruption, it is necessary that a fundamentally unlimited buffer capacity must be provided. Therefore all the following plants can only be operated at the bottleneck capacity. Obviously in such cases the conventionally used buffering constitutes an inadequate solution, if a high overall system capacity is sought. Therefore other known solutions, similar to the apparatus according to U.S. Pat. No. 4,402,496, have attempted to get round the bottleneck to a limited extent, in that the requisite processing capacity is divided up over several conveying or processing paths. Several fundamentally independent processing paths are created, which in turn use serial conveying. If e.g. a following processing is to be carried out with a work station which has a very high capacity, the separate following paths must be rejoined, which requires the use of complicated means. However, the subdivision of the conveying paths also suffers from the disadvantage that, apart from a large space requirement for the separated paths, each of said paths has its own control system, own processing means, etc. Thus, in actual fact the mechanical and organizational expenditure is increased. As a rule when subdividing the main conveying path the following paths are alternately fed through the sorting gates. Thus, for a short time, i.e. during the loading time from the main conveying path, each of the following paths must be able to assume the high conveying capacity of the main conveying path. Therefore the individual following paths must be designed for an equally high capacity, although this is only required for a short time, or buffers must be additionally used. With very high capacities, i.e. when processing 80,000 or more items per hour, conventional plants with serial conveying, which solve capacity problems with following paths, are confronted with fundamental problems, because the physical processing limits are reached.

SUMMARY OF THE INVENTION

An object of the invention is therefore to provide a method and means permitting, in a relatively small space, further processing of printed products with a very high, fundamentally upwardly open processing capacity without additional buffers and which can be readily integrated into an overall system with conventional conveying, this object also being achieved for extensive printed products.

A further object of the invention is to provide a method and means, permitting greater flexibility by means of capacities displaceable in the system, which allows simple and inexpensive extensions to be made with regards to the processing capacity in a highly efficient manner and with little machine expenditure and permitting active or passive redundancy of the work stations in a simple way.

Briefly described, the invention includes a method of conveying and processing printed products in a processing system comprising the steps of delivering printed products in a serial sequence from the output of a press, grouping printed products from the serial sequence into clusters, each cluster including at least two printed products, conveying a stream of clusters of products to a processing location, and processing the products in the clusters.

The invention leads to flexibility within the overall system, which is displaceable or usable at a selectable point in place of buffers, whose capacity is by definition poorly utilized. Thus, with a relatively small mechanical expenditure, very large processing capacity is obtained, which can be readily adapted to fluctuating productivity requirements.

BRIEF DESCRIPTION OF THE DRAWINGS

The invention is described in greater detail hereinafter relative to embodiments of the inventive method and means and relative to the attached drawings, wherein.

DESCRIPTION OF THE PREFERRED EMBODIMENT

Figure 1:
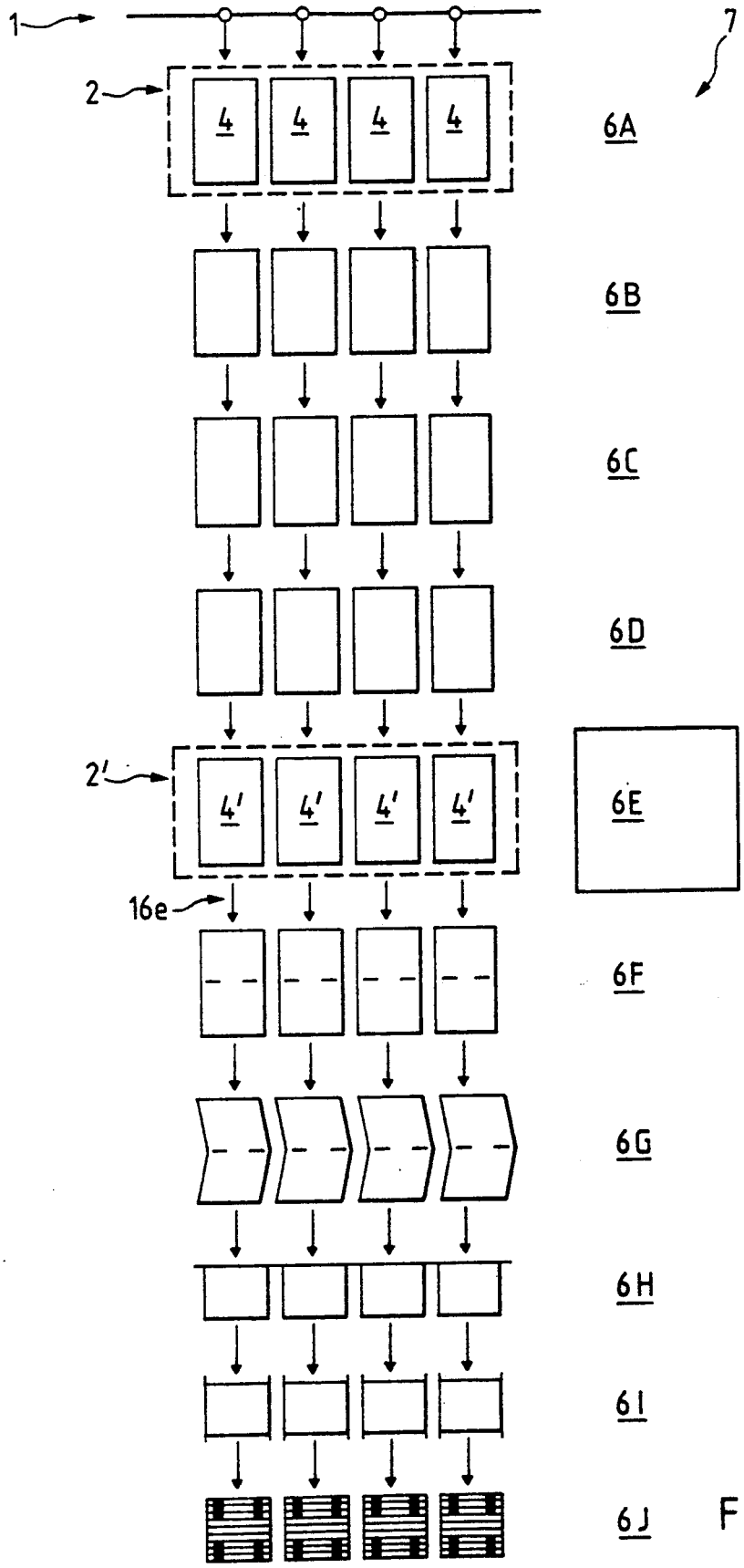
FIG. 1 is a schematic diagram of a cluster flow with clusters of in each case, four printed products.

In general, modern rotary presses have very high capacities, so that at the outlet from the rotary press the conveying of the printed products also requires high capacities, in order to be able to absorb the product of the press said capacity. It is also possible that higher processing capacities may only be required in subsequent working stages, because e.g. several material flows are combined from several feeders or from a store or buffer. It may also be necessary to maintain the necessary capacity for a specific working stage, which takes place slowly. In order to achieve these objectives, the inventive method and means can therefore be used at one or more selectable points in an overall system, or also over the entire processing path from the rotary press to the dispatch or forwarding station.

The invention makes use of the idea that the further processing of printed products should take place in parallel, i.e. the serial principle of conventional plants is abandoned. However, the information inherent in serial conveying and processing is to be retained in the parallel concept, so that it is called quasi-parallel. In this approach, in particular the conveying stroke or timing (synchronization) must be taken into account. The novel conveying and processing concept permits the integration of quasiparallel conveying into an existing plant with serial conveying, whilst retaining the synchronization of the processing and conveying and at all times permits the conversion of the quasi-parallel conveying back to serial conveying.

The invention aims at a parallel processing in the sense that not only are parallel, functional (time and material) and independent conveying segments provided, but functional parallel processing of the printed products is achieved. According to the invention the printed products are processing and conveyed in functional clusters. A printed product cluster is here understood to mean a group of at least two individual printed products processed in parallel at least over a partial segment or partial process. A cluster is a "group" with a functional relationship in the sense of a family. The reciprocal arrangement of the printed products of a cluster can vary and the individual printed product can have a certain freedom within the cluster. A functional parallel processing occurs if the printed products of a cluster are processed simultaneously, i.e. within the same time cycle, the printed products of a cluster either being subject to identical working steps, or the working steps at least have a reciprocal reference. In addition, the printed products of a cluster have a clearly defined relative arrangement, i.e. they are located in a mutually spatially defined position. In that a printed product cluster forms a logic group, at any time the clusters can be combined in simple manner with other clusters, recombined to form a serial conveying arrangement or can be brought together within a cluster. The formation of clusters can be understood as the organization of the printed products in functional groups. It is very important that the arrangement of the printed products within a cluster permits the processing of the individual printed products in a simple way. The printed products are for this purpose so reciprocally spaced or separated, that they are accessible in all areas (i.e. at all edges and lateral faces).

Therefore the invention differs fundamentally from conventional printworks conveying principles which, as stated, all carry out a subdivision of the main conveying segment into two or more parallel following paths, where no significance is attached to the functionally simultaneous processing of a cluster. On the basis of an ordered, serial conveying from the rotary press, e.g. in the form of a stream flow, when subdividing the main conveying segment the existing order is stepped down, i.e. this subdivision can only be reversed again with very considerable mechanical and financial expenditure. This is due to the fact that the following paths are functionally independent or decoupled, so that a bringing together of these paths into a serial, unitary flow can only be achieved by again transferring into a unitary, reciprocal arrangement with unitary phase and the like. However, in the method according to the invention, due to the cluster processing principle, the order of serial conveying is not destroyed, i.e. the internal interrelation is maintained. As will be explained hereinafter, it is readily possible to successively process or remove printed products over short distances, e.g. for a specific working step, without breaking up the clusters from the organizational or functional standpoint. The possibilities of serial conveying are fully retained in the inventive processing principle.

The inventive idea is based on a conversion of the conventionally serially supplied printed products, e.g. as a stream flow, into a cluster flow. This conversion can fundamentally take place at a random point in an overall system. The invention also makes it possible to convert the cluster flow at a random point into a conventional conveying process, possibly for a single working operation. The method possibilities claimed in the claims show the corresponding inventive arrangement possibilities. The design of the individual systems can take place with conventional means or with conveying and processing means specifically intended for cluster conveying.

FIG. 1 diagrammatically shows such a cluster flow 7. The printed products for the cluster are supplied by a not shown supply system 1, which can be e.g. constituted by one or more clamp or bracket conveyors, several feeders or any other printed product conveying means. From the supply system 1 printed products are simultaneously or successively removed e.g. with a clamp gripper and a first printed product cluster 2 is formed. The printed products 4 of a cluster must be arranged in such a way that each individual product is accessible for following processing. It is obvious that the reciprocal spatial arrangement can vary widely and must be matched to the desired working processes. In the represented embodiment four printed products are juxtaposed in a plane and are reciprocally oriented in parallel. The printed products combined into a cluster in this way remain in this reciprocal arrangement throughout the processing path, i.e. from work stations 6A to 6H and often up to the despatch point 6J. Each cluster 2 is subject to various work stages on the processing paths 6A to 6H. Obviously the printed products can be briefly taken out of the cluster, e.g. for a specific working stage. However, it is necessary that such printed products are reintegrated into the corresponding cluster immediately after the process, so that there is no loss of the functional homogeneousness within the cluster. At a working station 6E, e.g. the printed products 4' of a cluster 2' are successively removed from the arrangement of cluster 2' and processed in station 6E. In the conveying area 16*e* immediately following working station 6E the printed products 4' are once again in their functional arrangement within the cluster.

The term "end product" is understood to mean all printworks products such as exist after performing the inventive method, i.e. at the outlet from an inventive means, where generally a state suitable for despatch is reached. The term "starting product" is understood to mean all printed products, such as are supplied to a means according to the invention to be converted into end products. Starting products with different formats or sizes can be used for performing the inventive method.

Figure 2:
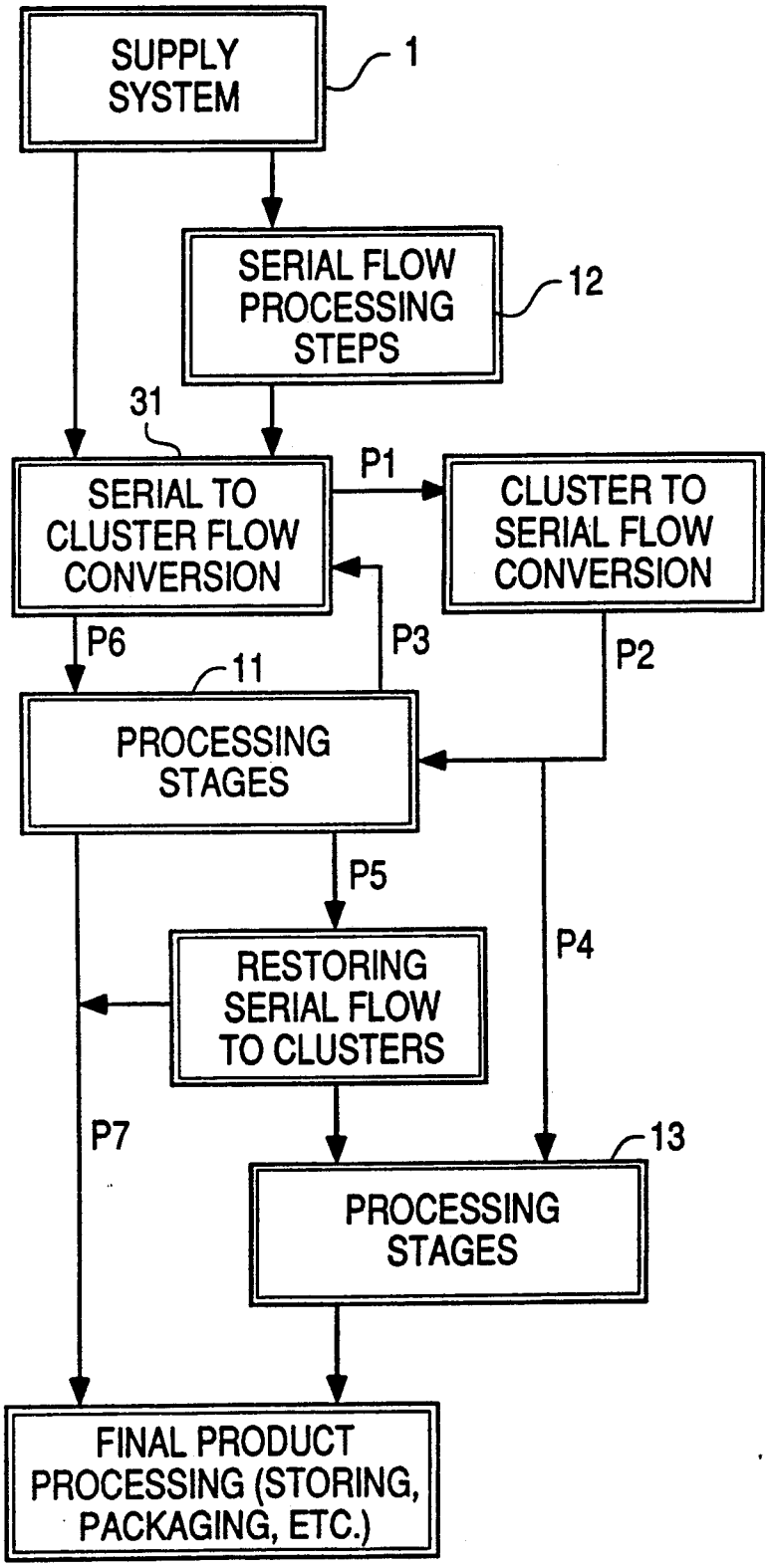
FIG. 2 is a block diagram of an example of a process sequence according to the invention.

FIG. 2 shows an example of an inventive process sequence illustrating the inventive principle. From a supply system 1, starting products are supplied in conventional, serial conveying order. At least part of the supply product flow is converted in a conversion means 31 into a cluster flow. In many cases all the starting products are converted into a cluster flow. This cluster flow now undergoes several working stages 11 and subsequently the processed end products are stored, packed, despatched, etc. The flexibility of the method is apparent from the further possibilities of which some are indicated by the additional paths in the drawing. It is e.g. possible to use certain working steps 12 on the as yet unconverted, serially conveyed product flow. This is e.g. desired if the inventive method is to be used within an overall system for the final processing only, i.e. at the end of the overall process. It is also possible to temporarily convert back into a serial system all or part of the cluster flow (indicated by path $p_1$-$p_2$-$p_3$) or for this to take place ultimately (indicated by path $p_6$-$p_5$). It is obviously also possible to apply additional working stages 11, 13 to these serially conveyed printed products. The drawing makes it clear that it is also possible for special applications to subdivide the product flow into a cluster flow ($p_6$-$p_7$) and a serially conveyed partial flow ($p_1$-$p_2$-$p_4$). It is therefore readily possible to process part of the printed products in a high capacity cluster flow and another part in a conventional way, so as to achieve optimization of the machine expenditure. It is obvious that further combination possibilities can be realized within the scope of the invention and without leaving the inventive concept, i.e. providing cluster processing in parts of the overall process requiring flexible conveying and processing with a high efficiency. It is obviously possible to guide several cluster flows in parallel, to mix cluster flows with conventionally conveyed products (e.g. inserts) or to combine cluster flows from different rotary presses or from a rotary press and store.

A survey of the most important fundamental possibilities is provided in the following table:

| Mixing | Combining | Splitting up | Reducing |
|---|---|---|---|
| Mixing different cluster flows to form a new cluster flow. | Combining different cluster flows to for a new cluster flow. | Splitting up a cluster flow into one or more cluster flows and/or a conventionally conveyed product flow. | Reduction of a cluster flow into one having a lower order (cf. below) |
| Mixing a cluster flow with a conventionally conveyed product flow. | Combining a cluster flow with a serially conveyed product flow. | Splitting up a conventionally conveyed product flow and conversion into at least one cluster flow. | Reduction of a cluster flow into a serial flow with individual products (cf. below) |

A combining of clusters or individual printed products occurs when these are brought together and the size of the cluster grows in such a way that the number of functional units therein rises. Mixing occurs if a first cluster is brought together with at least one second cluster and/or one or more serial printed product flows such that the number of elements in the cluster does not rise, but the size or bulk of the individual elements of the cluster does. Obviously splitting up of a cluster occurs if a cluster flow or its clusters are split up, i.e. there are at least two cluster flows within in each case a smaller number of elements per cluster. Thus, the splitting up of a cluster flow can be looked upon as the reverse of combining. Obviously the individual functions need not occur in pure form. Thus, e.g. there can be a bringing together of several cluster flows with simultaneous mixing/combining.

In view of the fact that the elements of a printed product cluster need not be individual printed sheets, simple tabloids, etc., but instead during the process said elements can grow to more comprehensive printed products, the size of a cluster can grow in two fundamentally different ways. On the one hand the number of elements can rise, or the bulk of the individual elements can rise. To illustrate this fact, for growth in the first sense, i.e. a rise in the number of elements within the cluster, reference is made to an increase in the order of the cluster. A second order cluster e.g. contains two printed products and a fourth order cluster four printed products. However, this makes no mention of the bulk of the printed products or the number of the components thereof. Therefore the combining of cluster flows can be understood as a conversion of e.g. two clusters into a higher order cluster, whereas mixing does not change the order of the cluster, but increases the bulk of the individual printed products contained in the cluster. Purely theoretically, it is possible to operate with the concept of one cluster or a first order cluster flow, which would correspond to a serial product flow. However, this would not constitute a printed product cluster in the sense of the invention, because the conceptual features of the cluster do not occur in an individual printed product, so that this expression is not used here.

Figure 3:
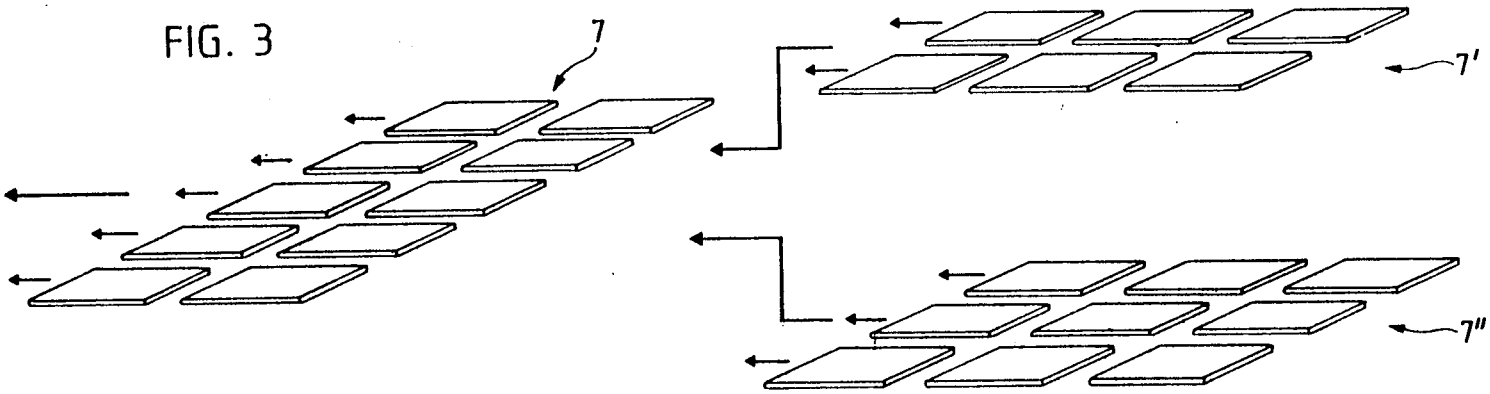
FIG. 3 is a schematic flow diagram illustrating the combining of two cluster flows of different orders to a fifth order cluster flow.

FIG. 3 illustrates the combining of a first cluster flow 7' (second order) with a second cluster flow 7'' (third order) to a cluster main flow 7 (fifth order). The two cluster flows 7', 7'' are superimposed in this example. Such an arrangement can be used if the printed products of the cluster flow 7' can be processed more slowly than those of cluster flow 7''. Generally the printed products within a cluster are identical, i.e. they have the same scope and are always located in the same processing stage. As a function of requirements, the information concerning the arrangement of the clusters in the flows 7' and 7'' can be retained after combining. However, in general the information concerning the coupled 'super' cluster 7 is used as a new output quantity, if a return to cluster flows corresponding to 7', 7'' is subsequently no longer necessary or desired.

It may also be desirable for special uses to combine different printed products in a cluster. Then e.g. different printed products would be combined in a cluster main flow 7 from cluster flow 7', 7''. An example of this is a fourth order cluster flow with four different printed products per cluster. This can be processed and subsequently reduced to a serial flow with individual products. The aforementioned reduction of a cluster can e.g. take place in such a way that the constituents of an end product, which are in fact conveyed and processed in such fourth order clusters, are stuck in one another in a final working stage.

Another important advantage of the invention idea of cluster processing is the possibility of integrating it into a conventional overall system with serial conveying and processing. An important advantage compared with known measures for increasing the capacity or speed is that cluster processing permits a timed operation. It is important that cluster processing takes place with a time cycle linked with the system time cycle or clock.

Figure 4:
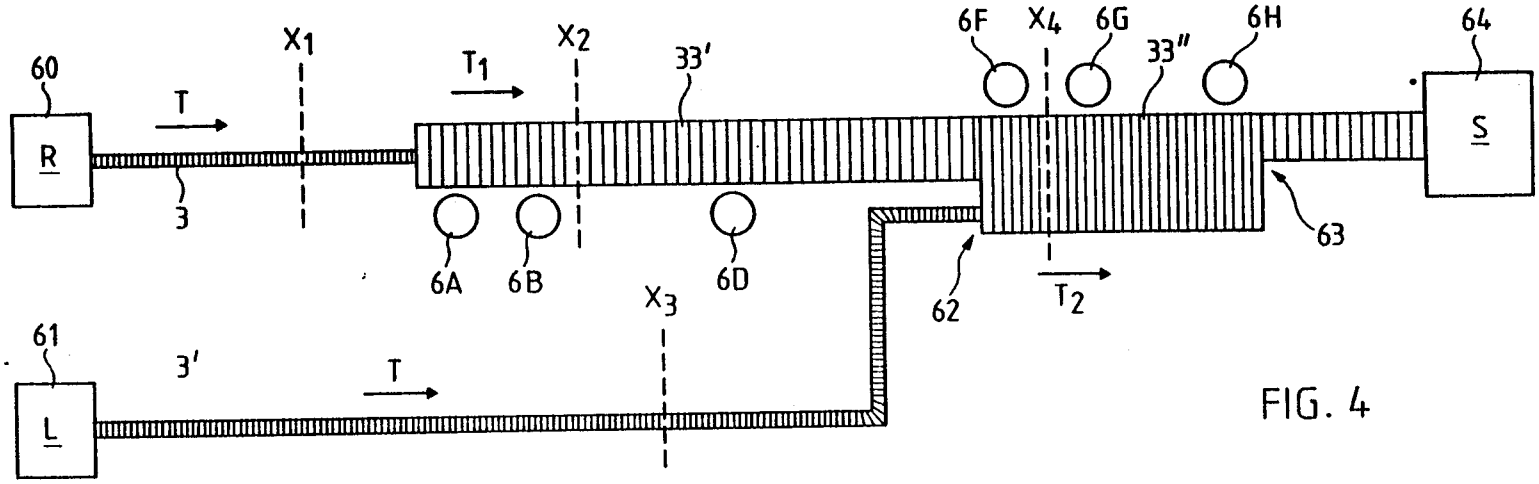
FIG. 4 is a schematic diagram of an embodiment of an overall system using the inventive method.

FIG. 4 diagrammatically shows the integration of two cluster processing segments 33', 33'' into an overall system. Printed products are conveyed from a rotary press 60 in conventional serial conveying form with a system clock cycle T (i.e. time between two supplied printed products, the unit being seconds). The passage value $A_1$ (number of printed products per second) at a random point $X_1$ of this first serial supply system 3 is calculated as $A_1=1/T$. In order to avoid additional buffering measures during the conversion into a cluster flow, it is necessary for this passage value to be maintained in the following cluster processing segment. Therefore at a point $X_2$ of the cluster processing segment the clock of the cluster conveying must be max $T_{1max}=n/A_1$. In this expression, n is the order of the cluster conveyed in the vicinity of segment 33' or the number of printed products thereof. It is clear that the cluster clock $T_1$ is linked via the cluster order with the system clock T. As buffering can be avoided if $T_1$ is smaller than $T_{1max}$, the ratio between the system clock T and the cluster clock $T_1$ is generally expressed as follows:

$$T_1=n/Y\cdot A_1=(n/Y)\cdot T(\text{Y:Parameter})$$

Through a suitable choice of the cluster order $n_1$ and the parameter Y (higher than 1), it is possible to so choose the conveying or processing speed along the cluster processing segment 33', that the cluster clock $T_1$ required by the working stages performed in this area is reached. An increase in the cluster order makes it possible to increase the length of the working clock cycle and therefore the performance of slower working stages, without having to lower the passage value. If $Y=1$, the cluster clock$=n\cdot T$ and therefore the passage value $A_2$ is twice as large as the passage value $A_1$.

Moreover, from a store 61 and via a supply system 3', starting products are conveyed preferably with the system clock T, so that the corresponding passage value $A_3$ at a random point $X_3$ is equal to $A_1$. If the cluster flow and the supply system 3' are now to be coupled to form a unitary cluster flow, then at a point $X_4$ it must have a passage value $A_4=A_1+A_3=2\cdot A_1$. The corresponding cluster clock $T_2$ on the cluster processing segment 33'' is max $n_2/(2\cdot A_1)$. So as to leave the two cluster clocks $T_1$ and $T_2$ the same in this example, consequently the $n_2$ order of the cluster in area 33'' must be at least twice as large as $n_1$.

In order to be able to process the clusters in sequence within the cluster clock $T_1$, $T_2$, the individual work stations 6A–6H must have a corresponding construction along segments 33', 33''. This means that these stations must have capacities corresponding to the passage value, if in each station all the printed products of a cluster have to be processed. As cluster processing is organized for slow working stages, in certain circumstances it may be necessary within a working station to simultaneously perform a working stage of several printed products of a cluster. This can e.g. take place by using several identical, synchronously controlled processing means. If e.g. on segment 33' fourth order clusters are conveyed and within a cycle $T_1$ in work station 6D all four printed products of a cluster are to be bonded, then four bonding means can be arranged in parallel. According to the desired function, the specific design of the work stations can vary considerably. If e.g. a working step in work station 6B only requires a very short work cycle, then the printed products of a cluster can be processed by means of one device, which serially processes the printed products. For this purpose the device is e.g. moved at right angles to the cluster conveying direction and one printed product after the other is processed.

Therefore the size of a cluster is preferably also chosen as a function of the clock cycle or conveying speed $T_1$, $T_2$ desired for cluster processing. If relatively slow processing steps are to be performed for the processing of the printed products following conversion into a cluster flow, then the cycle $T_1$, $T_2$ can be increased, or the conveying speed of the printed product clusters decreased, so that the following steps can be performed within the scope of the necessary work cycles. It is a major advantage of the inventive method, that the individual working steps, as a function of the choice of the size of the clusters and the cluster clock, can take place relatively slowly. This makes it possible to use inexpensive, slowly operating components within very fast overall processes. In addition, interface problems such as occur due to different processing speeds of the individual components are largely avoided.

If parameter Y is made relatively large, i.e. $Y>>1$ (e.g. 5), assuming that this is allowed by the work cycles of work stations 6F–6H, then it is possible to achieve a relatively short cluster clock $T_2$ and therefore a certain buffering at conversion point 62. Subsequently this leads to gaps in the cluster flow (empty clusters) in normal operation, so that this buffering possibility can only be used to a limited extent.

However, a true buffering is preferably achieved in that the cluster processing segments allow a variable, large cluster size. If e.g. such a segment is designed for conveying and possibly also processing twelfth order clusters, in normal operation only fourth order clusters are conveyed and processed, so that buffering up to three times the capacity is possible. Such a solution is advantageous if active or passive redundancy is to be created within a system for certain work stations. It is therefore simply possible to provide redundancy of the work stations, in that all or part of the cluster processing segment is designed for conveying relatively high order clusters (e.g. fifth order and higher). During normal operation with lower order clusters, there can either be a buffering, or work stations can be made redundant. Buffering is realized in that clusters of variable size are formed following a conversion point 62 by means of a monitoring/control unit, e.g. a SPS or computer control unit, so that buffering is made possible by varying the cluster size.

It is obvious that in normal operation conventional clusters of identical order are formed and the cluster size is only varied for buffering.

The cluster flow in the example of FIG. 4 is reduced to a lower order cluster flow. If e.g. via the cluster processing segment 33' partial products were supplied (e.g. the content of a brochure) and the supply system 3' supplied wrappers, then following the conversion point 62 partial products and wrappers are simultaneously arranged in a cluster. At reduction point 63 the partial products are inserted in the wrappers and supplied as a lower order cluster flow to despatch point 64 or to further storage or conveying systems.

The linking of the cluster clock cycles with the system clock cycle makes it possible at any time to reconvert a cluster flow into a serial conveying flow. It is therefore possible to use cluster processing for a limited area within an overall system, e.g. only for labour intensive operations. This provides a significant difference compared with conventional systems, which subdivide a printed product flow into several time-decoupled and therefore also cycle-decoupled following paths for increasing capacity, so that flexibility is lost in other areas. An adaptation of the system clock and cluster clock is an important element with regards to the return to a serial conveying arrangement with the same input parameters (clock, phase, etc., as occurred prior to the cluster processing segment).

It is also possible and preferred for specific applications, to convey the cluster flows continuously or alternatively continuously/cyclicly. If working steps are to used on a continuously conveyed cluster flow, the corresponding work stations must permit a continuous operation. This can take place by means of working devices carried after or along with the flow in rotary manner.

Figure 5:
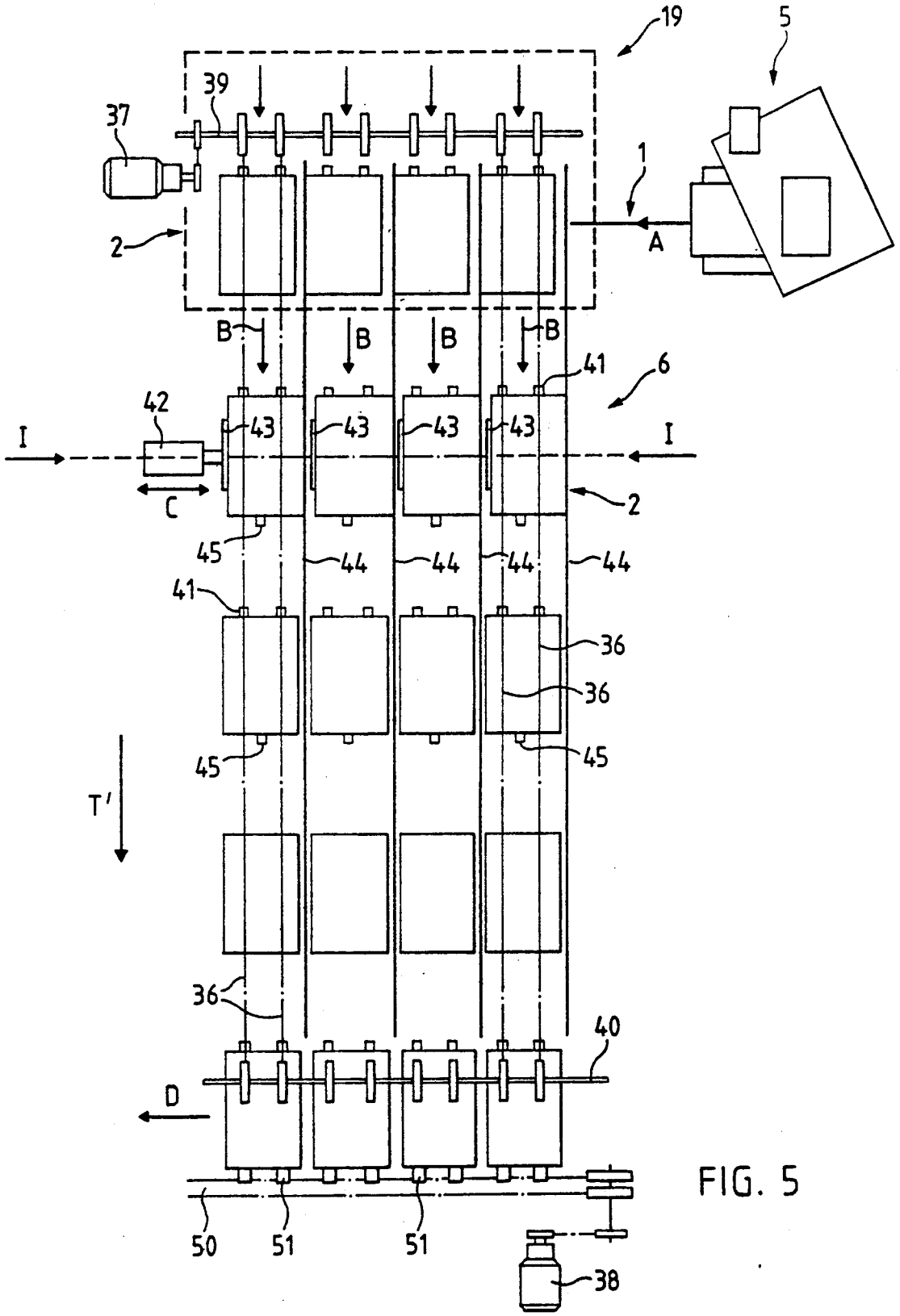
FIG. 5 is a schematic diagram of an embodiment of a conveyor for a fourth order cluster flow.

The conveying means are designed for conveying nth order clusters. FIG. 5 diagrammatically shows an embodiment for conveying a fourth order cluster flow. Each printed product cluster 2 contains four printed products. By means of a diagrammatically represented feeder 5, the printed products are supplied and individualized. It must be borne in mind that to facilitate understanding, feeder 5 has been shown much smaller. The printed products are supplied thereto via not shown conveying means, e.g. a clamp conveyor, or as a stream flow. Such a feeder 5 and the manner in which separation takes place can be performed conventionally. The printed products separated or individualized in this way are supplied by means of a supply system 1, e.g. a clamp conveyor in the direction of arrow A, to a removal point. In this embodiment the clusters 2, which are brought together in removal station 19, are conveyed by several chain strands 36 and conveyed to the work stations. The chain strands are indicated by dot-dash lines.

A common drive shaft 39 is driven by means of a first motor 37. The revolving chain strands 36 are guided by means of guide wheels to the drive shaft and a second shaft 40. These chain strands 36 are preferably driven with a clock cycle T'. At regular intervals conveying cams 41 are arranged on the chain strands 36 (only two cams 41 shown in the drawing). As can be seen eight such chain strands 36 are provided for conveying a cluster with in each case four printed products. Each individual product is conveyed by two conveying cams 41 in the direction of arrow B. As the chain strands 36 are jointly driven, the printed products are always synchronously conveyed in this embodiment. The printed products are preferably located on conveying plates, which can have a conventional construction. The conveying cams 41 ensure a parallel orientation of the printed products in the conveying direction. The reciprocal lateral orientation of the printed products is diagrammatically shown for a first work station 6. By means of a lift cylinder 42 vertical guide plates 43 are moved backward and forwards at right angles to the conveying direction in the direction of arrow C. Therefore the individual printed products of a cluster are moved against guide rails or plates 44 and therefore laterally correctly positioned. Moreover, at the individual work stations there are countercams 45 for positioning the clusters in the conveying direction. The timed conveying and processing of the clusters makes it possible for the individual printed products of a cluster to be finally oriented only at the individual work stations. At a transition point or station the clusters are taken up e.g. by a gripper chain 50 with a plurality of grippers 51 driven by a second motor 38 and conveyed on in the direction of arrow D.

For realizing a conveyor for higher order clusters, it is e.g. possible to increase the number of chain strands 36. If in normal operation only fourth order clusters are processed, the then unused chain strands can be used in the sense of a passive redundancy in the case of faults. Simply switching over the active conveying means to the passive makes it possible to "get round" the failure of certain working means.

The conveying means for the clusters can all have a unitary construction, e.g. a common conveyor belt optionally provided with grippers is used with which the printed products of the clusters are conveyed. This makes it possible to reduce the material and conveying expenditure for conveying the clusters. It is obvious that the conveying and processing of the clusters on common conveying means can take place in a much smaller area as compared with the conventional subdivision of product flows over following paths.

Figure 6C:
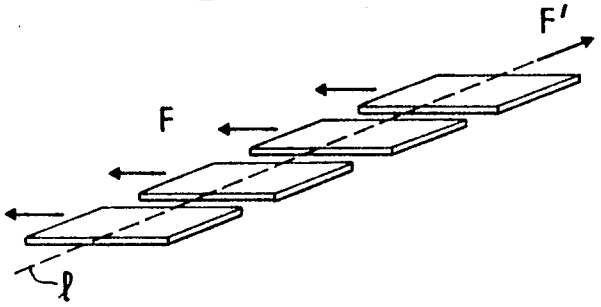
FIGS. 6*a*, 6*b* and 6*c* are schematic diagrams of three possible arrangements of the printed products in a cluster.
Figure 6B:
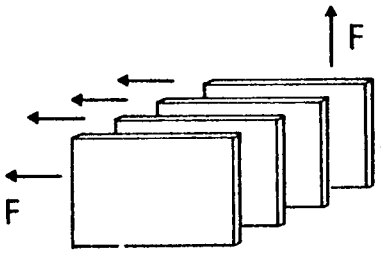
Figure 6A:
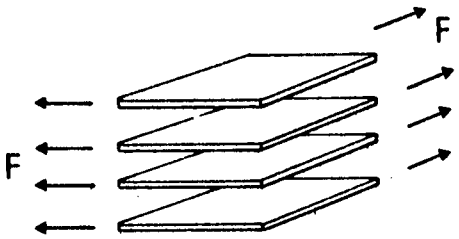

The spatial arrangement of the printed products within a cluster, as well as the actual clusters can undergo wide variations within the scope of the invention. FIGS. 6*a* to 6*c* show cluster conveying examples. The printed products are arranged in parallel in fourth order clusters. Obviously the parallel orientation is not essential to the invention, but these arrangements constitute preferred use examples. In that of FIG. 6*a* the printed products are superimposed and conveyed substantially horizontally. FIG. 6*b* shows a fourth order cluster with parallel, juxtaposed printing products. Such an arrangement is e.g. suitable for conveying with a clamp conveyor. The conveying direction is preferably that of arrow F. In this reciprocal arrangement of the printed products they are readily accessible for following working steps and the regular parallel orientation permits easy conversion into conventional conveying and back again. In order to make the printed products better accessible for certain work stations, the conveying direction F or the arrangement of the printed products within the cluster on a cluster processing segment can be varied. For example, an arrangement according to FIG. 6*b* can be achieved by a spatial 90° rotation of clusters according to FIG. 6*a*.

It must also be borne in mind that there can be a change to the format of the individual printed products during processing. The folding of starting products supplied in tabloid from leads to the fact that smaller-format two-folds are obtained in the clusters. However, this format change has no influence of the functional organization of the printed products in the cluster.

Particular attention should be paid to the arrangement of FIG. 6*c*, in which the printed products are organized parallel to one another in one plane in a line *l*. Particularly the conveying direction towards arrow F′ could be looked upon as serial conveying on the basis of the drawing. However, as the represented printed products are functionally combined in a cluster, despite the conveying on a line the quasi-parallel conveying character is retained. However, it is possible to serially process the printed products within such a cluster in individual work stations by conveying in a line. A modification to the conveying direction of such clusters between directions F and F′ can therefore lead to important advantages, if certain working processes to be applied to the printed products require special accessibility due to the construction of the corresponding processing means. Since, as a function of the conveying direction, the conveying means can have widely differing constructions (e.g. parallel chain strands for conveying direction F or an individual gripper chain for conveying direction F′), the conveying directions have considerable importance.

In the method according to the invention each individual printed product is processed quasi-parallel in a cluster, but each starting product is processed individually, in functional association with the other printed products of the cluster. Despite the functional association of the printed products within a cluster, it is possible to release the printed products in temporary manner from their generally constant, reciprocal association. It is important within the framework of the invention, that the information concerning the association of the printed products of a cluster or family is retained. The arrangements e.g. shown in FIGS. 6*a* to 6*c* can consequently be temporarily spatially completely separated without "destroying" a cluster. It is merely necessary that the cluster can be regenerated by a control or monitoring means.

However, a regeneration is also possible by interchanging individual printed products with identical replacement products. A cluster, in which e.g. a printed product has to be removed through being defective, can be replaced by an identical printed product. It is also possible to mutate a cluster flow by systematic addition or replacement of individual or several printed products within the cluster. Such a mutation can e.g. be desired if, within the scope of the production of a newspaper a regional section is only to be added to part of the overall production run. Regeneration or a temporary breaking up of the cluster is possible in conjunction with an automated computer control, because the latter can monitor the position and organization of the cluster and/or the individual printed products.

It is an important advantage that the invention also offers flexible possibilities with respect to the organization within the cluster. In an important application the clusters in each case contain identical printed products. In addition, it is possible to provide within a cluster the different partial products (components) of an end product, to process the same and e.g. compile them to the end product by reduction. By mixing a cluster with a lower order cluster e.g. parts of a large run can be given individual supplements or partial products.

However, flexibility is also ensured regarding the working processes applied to the clusters. Thus, e.g. in one work station a first working step can be applied to part of the printed products of the cluster and which differs from that which is applied to the remaining products of the cluster. Thus, immediately following this work station, there are differently processed printed products within the cluster.

Figure 7:
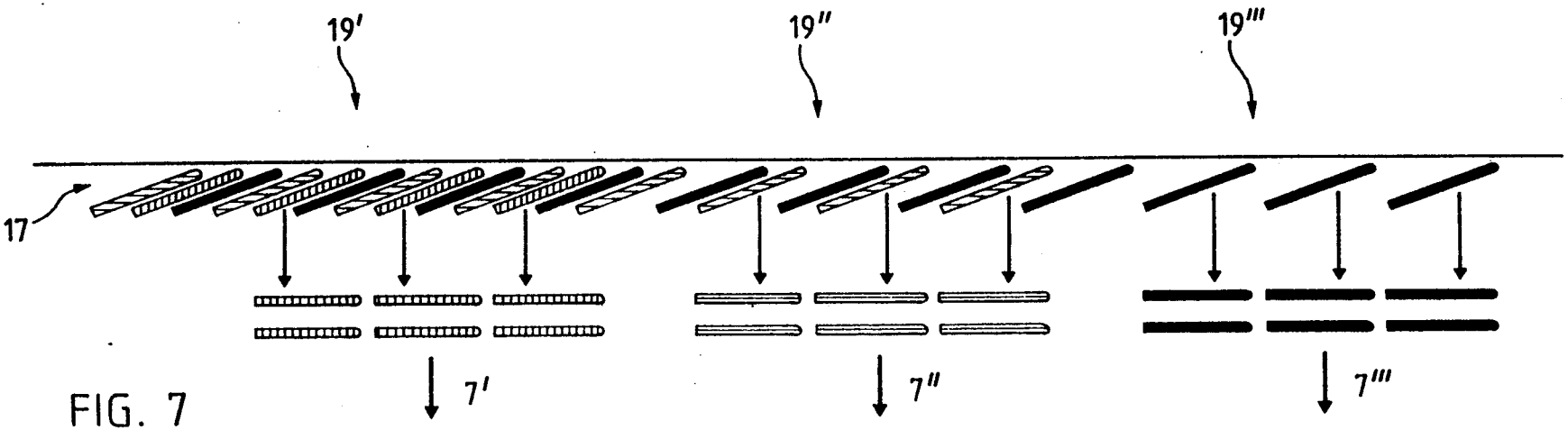
FIG. 7 is a schematic diagram of an example of a removal of printed products from a stream flow for forming three parallel cluster flows.

It is obviously also possible to form several cluster flows from a unitary serially conveyed product flow. FIG. 7 shows the formation of three parallel cluster flows 7′, 7″, 7‴ at three removal stations 19′, 19″, 19‴. The individual printing products are e.g. removed from a product flow 17 conveyed by means of a timed conveyor using a product clip or clamp according to U.S. Pat. No. 779,917, Eberle. Thus, every third copy is removed at each removal station from the left conveyed stream flow. Different hatching is used in the drawing to show the printed products intended for the different cluster flows.

The cluster flows 7′, 7″, 7‴ can at any time be recombined into a unitary stream flow. The clusters are physically broken up, but the functional association of the printed products of a cluster can be stored. Even in the case of such a temporary bringing together to a stream flow, the information regarding the cluster association of the individual printed products can be retained and at a later time the original cluster can be regenerated from the printed products belonging to a family.

I claim:

1. A method of conveying and processing printed products in a processing system comprising the steps of
delivering printed products in a serial sequence from the output of a press,
grouping printed products from the serial sequence into clusters, each cluster including at least two printed products and wherein, in the step of grouping, a plurality of products are arranged parallel to each other in substantially the same plane and aligned transversely with respect to the direction of conveying,
conveying a stream of clusters of products to a processing location, and
processing the products in the clusters.

2. A method of conveying and processing printed products in a processing system comprising the steps of
delivering printed products in a serial sequence from the output of a press,
grouping printed products from the serial sequence into clusters, each cluster including at least two printed products,
conveying a stream of clusters of products to a processing location,
processing the products in the clusters, and
mixing or combining the stream of clusters with the products of a serial stream of printed products.

3. A method of conveying and processing printed products in a processing system comprising the steps of
delivering printed products in a serial sequence from the output of a press,
grouping printed products from the serial sequence into clusters, each cluster including at least two printed products,
conveying a stream of clusters of products to a processing location,
processing the products in the clusters, and reducing the number of printed products in each cluster.

4. A method of conveying and processing printed products in a processing system comprising the steps of
delivering printed products in a serial sequence from the output of a press,
grouping printed products from the serial sequence into clusters, each cluster including at least two printed products,
conveying a stream of clusters of products to a processing location, and
processing the products in the clusters, and wherein the step of conveying includes
regulating the advance of each cluster in accordance with a cluster clock cycle.

5. A method according to claim 4 wherein the processing is performed in synchronism with a cluster clock cycle.

6. A method according to claim 5 wherein the processing system is operated in accordance with an overall system clock cycle T and wherein the clusters are conveyed and processed in accordance with a cluster clock cycle $T_1$ linked with the system clock cycle T in accordance with the relationship $T_1=(n/Y)\ T$ wherein Y is a real number greater than 1 and n is the number of printed products in each cluster.

7. A method according to claim 5 wherein the processing system is operated in accordance with an overall system clock cycle T, wherein the clusters are conveyed and processed in accordance with a cluster clock cycle $T_1$, and wherein T is substantially equal to $T_1$, whereby a buffering effect is achieved following conversion from serial to cluster flow.

8. A method according to claim 7 and further including converting a stream of products into clusters of different orders, having different numbers of products therein, whereby a buffering effect is achieved by the formation of high order clusters.

9. A method of conveying and processing printed products in a processing system comprising the steps of
delivering printed products in a serial sequence from the output of a press,
grouping printed products from the serial sequence into clusters, each cluster including at least two printed products,
conveying a stream of clusters of products to a processing location, and
processing the products in the clusters in synchronism with a cluster clock cycle.

10. A method of conveying and processing printed products in a processing system comprising the steps of
delivering printed products in a serial sequence from the output of a press,
grouping printed products from the serial sequence into clusters, each cluster including at least two printed products,
conveying a stream of clusters of products to a processing location,
processing the products in the clusters at a work station, and
subjecting at least one of the products within a cluster to a working step at the work station at a time displaced from the working step performed on the remaining products in the same cluster.

11. A method of conveying and processing printed products in a processing system comprising the steps of
delivering printed products in a serial sequence from the output of a press,
grouping printed products from the serial sequence into clusters, each cluster including at least two printed products,
conveying a stream of clusters of products to a processing location,
processing the products in the clusters, and
providing a supply or printed products separate from the products being processed in the system, and
periodically exchanging a printed product in the system with one from the separate supply.

12. A system for processing printed products received serially from the output of a rotary press comprising
a cluster processing segment including means for grouping printed products into clusters,
a plurality of work stations for processing printed products in clusters of products, and
means for conveying said clusters to said work stations, said means for conveying including
first and second conveyor sections located respectively upstream and downstream of said means for grouping, in the direction of conveyance, a common drive means connected for synchronously driving said first and second conveyor sections, a third conveyor section for delivering serially arranged printed products, and a conversion station for combining printed products delivered by said third conveyor section with printed products delivered by at least one of said first and second sections.

13. A system according to claim 12 wherein each of said work stations includes a plurality of product processing means corresponding to the number of products in each cluster, whereby each product in a cluster is processed at each work station in a predetermined interval.

14. A method of conveying and processing printed products in a processing system comprising the steps of delivering printed products in a serial sequence from the output of a press, grouping printed products from the serial sequence into clusters, each cluster including at least two printed products, conveying a stream of clusters of products to a processing location, processing the products in the clusters, and converting the stream of products into clusters of different orders, having different numbers of products therein, whereby a buffering effect is achieved by the formation of high order clusters.

* * * * *